US006317046B1

(12) United States Patent
Fresnel et al.

(10) Patent No.: US 6,317,046 B1
(45) Date of Patent: Nov. 13, 2001

(54) FIXING AN ANTI-THEFT LABEL ON AN OBJECT USING A HEAT-SHRINKABLE ENVELOPE

(75) Inventors: Eric Fresnel, Paris; Alain Dameme, Neauphle-le-Chateau; Didier Gouelibo, Cernay-la-Ville, all of (FR)

(73) Assignees: Sensorimatic France, Antony; Sleever International Company, Morangis, both of (FR)

( * ) Notice: Subject to any disclaimer, the term of this patent is extended or adjusted under 35 U.S.C. 154(b) by 0 days.

(21) Appl. No.: 09/424,074

(22) PCT Filed: May 19, 1998

(86) PCT No.: PCT/FR98/00994

§ 371 Date: Feb. 20, 2000

§ 102(e) Date: Feb. 20, 2000

(87) PCT Pub. No.: WO98/53169

PCT Pub. Date: Nov. 26, 1998

(30) Foreign Application Priority Data

May 23, 1997 (FR) ..... 97 06312

(51) Int. Cl.[7] ..... G08B 13/14

(52) U.S. Cl. ..... 340/572.9; 340/568.1; 206/807; 70/57.1; 24/455

(58) Field of Search ..... 340/572.9, 572.8, 340/572.1, 568.1, 571; 206/207; 70/57.1; 24/455

(56) References Cited

U.S. PATENT DOCUMENTS 5,079,540 * 1/1992 Narlow et al. ..... 340/572.8
5,437,172 8/1995 Lamy et al. ..... 70/57.1
5,524,463 * 6/1996 Schenkel et al. ..... 70/57.1
5,570,080 * 10/1996 Inoue et al. ..... 340/571
5,627,520 * 5/1997 Grubbs et al. ..... 340/572.1
5,646,592 * 7/1997 Tuttle ..... 340/572.6
5,910,768 * 6/1999 Ott ..... 340/568.2
5,969,613 * 10/1999 Yeager et al. ..... 340/572.9

FOREIGN PATENT DOCUMENTS 0 615 041 9/1994 (EP) .
0 698 561 A1 2/1996 (EP) .

OTHER PUBLICATIONS

English Abstract of European Patent Application No. 0 698 561 (Sleever International Company).

* cited by examiner

*Primary Examiner*—Benjamin C. Lee
(74) *Attorney, Agent, or Firm*—Nixon Peabody LLP; Stuart J. Friedman

(57) ABSTRACT

The invention relates to a device (10) for making an antitheft link between two objects, the device comprising an envelope (20) of heat-shrink plastics material whose walls are locally brought together along a common generator line (23) to form both a main compartment (24) which is open at both ends and which is designed to envelop one of the two objects to be connected together, and an auxiliary compartment in which an elongate pin is disposed. The device has a wall (31) provided on the other object (30) with a narrow longitudinal slot (32) formed therein that is open at one of its ends, said slot being dimensioned to enable the envelope to be inserted level with its common generator line (23) so that the elongate pin co-operates with the wall (31) to provide the link between said other object and the envelope which has been heat-shrunk on the first object, and to enable the inserted envelope (20) to be locked into place by means (36) closing the open end of the slot (32).

16 Claims, 4 Drawing Sheets

FIXING AN ANTI-THEFT LABEL ON AN OBJECT USING A HEAT-SHRINKABLE ENVELOPE

FIELD OF THE INVENTION

The present invention relates to the field of packaging objects and to the field of protecting such objects against theft, and more particularly to an antitheft link between two objects.

BACKGROUND OF THE INVENTION

Every day, stores are the victims of shoplifting or "shrinkage", and as a result they suffer loss of earning by amounts that are considerable. The fight against this scourge has led to the development of ever more sophisticated protection systems.

The technological background of the invention can be illustrated by document FR-A-2 605 747 which describes a method consisting in permanently integrating a flat resonant circuit in an object, which circuit operates within a gate that broadcasts a radiofrequency electromagnetic wave, by document FR-A-2 358 713 which describes an antitheft marker of ferromagnetic material fixed on the object that is to be protected, and by document WO-A-85 02285 which describes an alarm system using a tape comprising two superposed strips that are sandwiched between a face of the object and a protective label.

Reference can also be made to document EP-A-0 698 561 and EP-A-0 698 562 describing packaging of heat-shrink plastics material fitted with a metal filament constituting an antenna for an electronic surveillance system operating on a magnetic detection principle, said filament being organized on the inside wall of the packaging in the first document or being integrated in a tear strip in the second document. The techniques described in those documents are advantageous, but they can sometimes be difficult to implement with objects or portions of objects having a section of small size (for example, the temple of a pair of eyeglasses, the clip of a pen).

There also exists an antitheft system using a tie surrounding a portion of the object concerned. Thus, document EP-A-0 615 041 describes a reusable antitheft device for eyeglasses, comprising a tie that is reinforced by two steel cables associated with a fastening plate provided with locking means that can be released only with the help of a special tool.

Various other antitheft systems are known of the type comprising a rigid box or label fixed to the object concerned by staples or by adhesive. Recently, an advanced technology known as "magnetoacoustic" technology has been developed, whereby the antitheft system is constituted by two adjacent metal wafers (separated by an insulating wall) suitable for being set into vibration at a relatively low, predetermined frequency (e.g. about 60 kHz). The advantage of that type of protection system is that the system can be inhibited and reactivated at will, as often as desired. Usually, such a protection system is placed in a box having one adhesive face, so as to be applied directly against a wall of the object to be protected. As will easily be understood, for objects or portions of objects that are of small section, it becomes difficult or even impossible to fix such a box fitted with a magnetoacoustic system, with this being for purely mechanical reasons.

SUMMARY OF THE INVENTION

The invention seeks specifically to solve the problem of providing an antitheft link between two objects, and to provide a technique that avoids the above-mentioned drawbacks.

The invention thus provides an antitheft link device between two objects, which device is both simple in structure and suitable for providing good protection in terms of theft-proofing, while nevertheless being easy to install.

More particularly, the invention provides a device for making an antitheft link between two objects, the device comprising:

an envelope of heat-shrink plastics material, implemented in the form of a sleeve whose walls are brought together locally along a common generator line to form a main compartment and an auxiliary compartment, the main compartment being open at both ends and being designed to envelop a first one of the two objects to be connected together, and the auxiliary compartment having an elongate pin disposed therein, which pin extends parallel to said common generator line;

a wall provided on the other object, which wall has formed therein a narrow longitudinal slot opening out at one of its ends, said slot being dimensioned firstly to enable the common generator line of the above-mentioned envelope to be inserted therein so that the associated elongate pin is disposed behind the wall and co-operates therewith to provide the link between said other object and the envelope when heat-shrunk onto said first object, and secondly to lock the envelope as inserted in the slot by associated locking means organized to close the open end of said slot; and antitheft means integrated in the envelope, and/or at least one of the two objects.

Preferably, the elongate pin is held in the associated auxiliary compartment of the envelope by adhesive. Naturally, in a variant, it would be possible to bond the facing walls of the envelope together along the common generator line.

Advantageously, the elongate pin is a single piece extending over the full length of the associated auxiliary compartment of the envelope. In particular, provision could be made for the elongate pin to be made in the form of a bar or a tube of plastics material.

According to another advantageous characteristic of the device, the envelope is also fitted with antitheft means in the form of a metal filament constituting an electromagnetic antenna, said filament extending along a generator line of the main compartment. Preferably, the metal filament is disposed level with an inside flap of the sleeve constituting the envelope, and the outer wall of said sleeve has a local cutout or notch level with one end of the filament to enable it to be grasped for the purpose of tearing said wall. The antenna-filament then also acts as a tear strip. Whether or not an antenna-forming metal filament is provided, it is also possible to provide for the envelope to be fitted with a tear strip extending along a generator line of the main compartment.

In an advantageous embodiment, one of the objects is an elongate identity and/or antitheft plate. In particular, the elongate plate may be implemented in the form of a box serving to house antitheft means such as an antenna for magnetoacoustic detection, and one of the walls of the elongate plate is the wall having the narrow longitudinal slot.

Advantageously, the locking means associated with the narrow longitudinal slot is constituted by a locking catch which is either snap-fastenable to the wall or else is connected to the wall by a hinge-forming ligament such that said catch can pivot between a release position in which the entrance of the slot is disengaged, and a locking position in which the entrance of the slot is closed. In which case, the ligament is designed to allow use on a limited number of occasions, thereafter breaking naturally. It would also be possible to provide for the above-mentioned catch to be lockable in its locking position e.g. by a stud secured to said catch and snap-fastening in the slot.

Also advantageously, the locking means associated with the narrow longitudinal slot is constituted by a pair of inlet barbs organized to allow passage in the insertion direction only.

The invention also provides a heat-shrink envelope specially designed to constitute a link device having one or more of the above-specified characteristics, said envelope being made in the form of a sleeve of heat-shrink plastics material whose walls are brought together locally along a common generator line to form both a main compartment open at both ends, and an auxiliary compartment in which an elongate pin extending parallel to said common generator line is held in place.

Preferably, said envelope is fitted with antitheft means in the form of a metal filament constituting an electromagnetic antenna, said filament extending along a generator line of the main compartment.

BRIEF DESCRIPTION OF THE DRAWINGS

Other characteristics and advantages of the invention appear more clearly in the light of the following description and the accompanying drawings relating to a particular embodiment and with reference to the figures, in which.

DESCRIPTION OF THE PREFERRED EMBODIMENT

Figure 1:
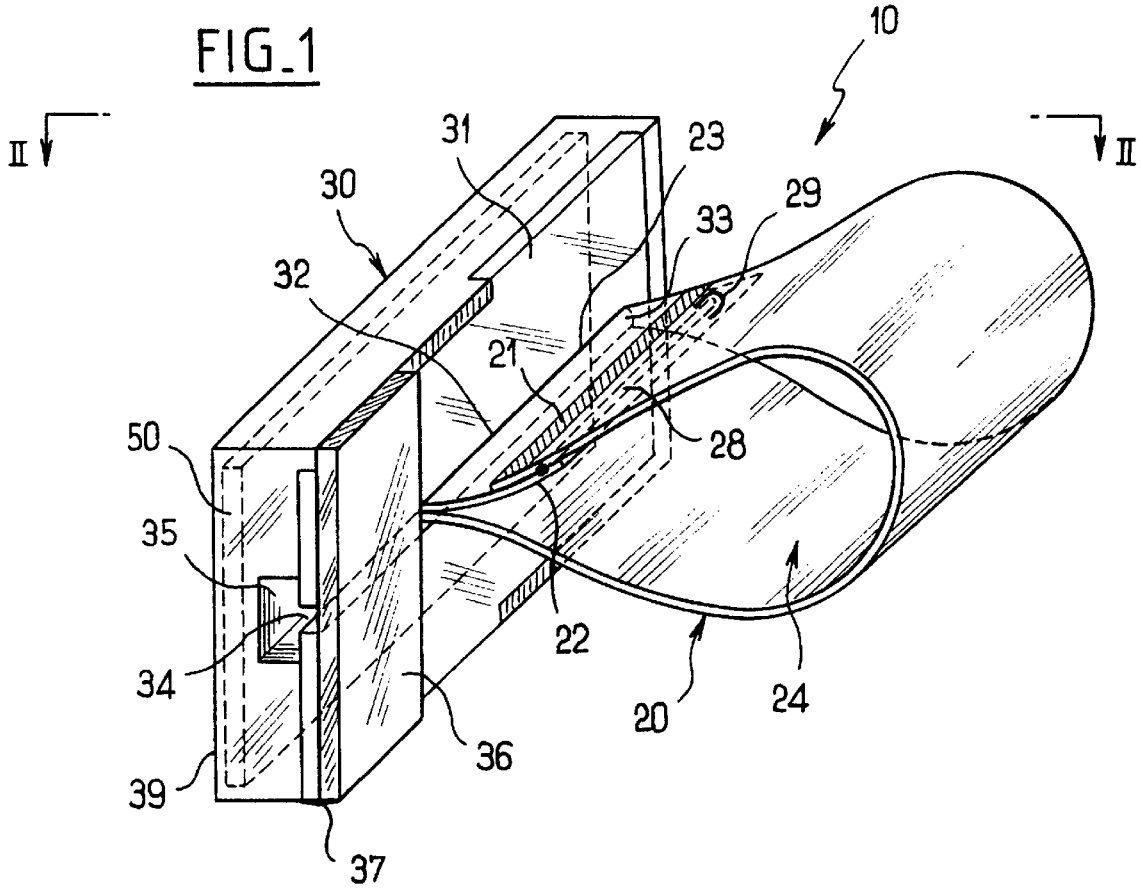
FIG. 1 is a perspective view of a device of the invention, with its envelope ready to receive an object, the other object being constituted in this case by an elongate plate fitted with antitheft means.
Figure 2:
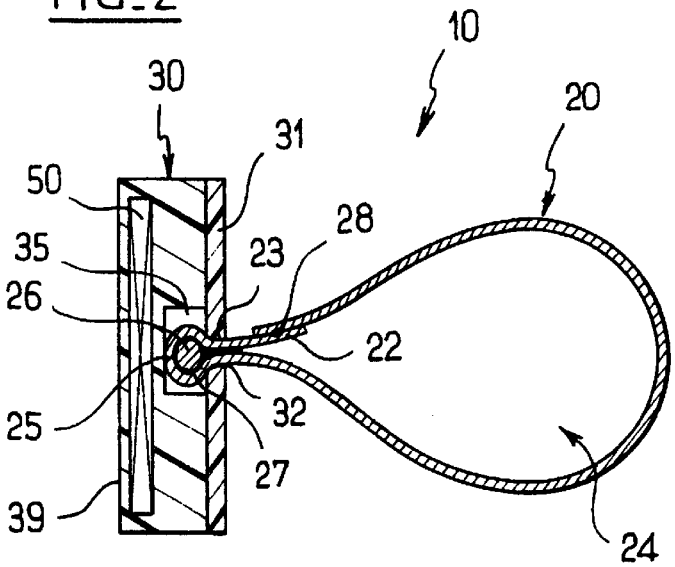
FIG. 2 is a section on II—II of FIG. 1, showing more clearly the link between the envelope and the plate by means of an elongate pin which is held captive in the plate.

FIGS. 1 and 2 show a device 10 for making a link between two objects and constituting a first variant of the invention in which the object having the wall with a longitudinal slot is an elongate plate, which in this case is fitted with antitheft means.

The device 10 is essentially constituted by two main components which are organized so as to be associated with each other in non-separable manner.

The first of these components is an envelope referenced 20 made of heat-shrinkable plastics material in the form of a sleeve. The strip of plastics material is looped, presenting a line of sealing referenced 21 along one of the generator lines of the sleeve, forming an end flap 22 which, in this case, is located inside the sleeve. The walls of the sleeve are moved towards each other locally along a common generator line referenced 23 to form a main compartment referenced 24 which is open at both ends and is designed to surround a first one of the two objects to be interconnected (not shown in FIGS. 1 and 2), the other object being constituted by the above-mentioned plate, and an auxiliary compartment referenced 25 which in this case is of much smaller section than the main compartment, and in which an elongate pin 26 is placed (not visible in FIG. 1), extending parallel to the above-mentioned common generator line 23.

The elongate pin 26 may be held in the auxiliary compartment 25 of the envelope 20 by adhesive, as can be seen more clearly in FIG. 2, where there can be seen a thickness of adhesive 27 surrounding the pin 26. In a variant, it is possible to have the walls come close together in localized manner and for them to be bonded along the common generator line where the facing inside walls come into contact. Nevertheless, adhesive has the advantage of holding the elongate pin securely in place, which pin performs a function that is explained below. The elongate pin 26 is preferably a single piece, extending over the entire length of the associated auxiliary compartment 25 of the envelope 20, with the advantage of a one-piece pin being that good mechanical strength is obtained that is uniformly distributed over the entire length of the sleeve. It is shown below that this is particularly important insofar as the elongate pin is to serve as a link member in a mechanical fastening process. The elongate pin 26 could be implemented in the form of a pin or tube of plastics material, with the particular material used being relatively unimportant providing it has sufficient mechanical strength against collapsing when subjected to forces directed along its axis.

It can also be seen in FIG. 1 that the envelope 20 is also fitted with a metal filament referenced 28 that constitutes an electromagnetic antenna, said filament extending along a generator line of the main compartment 24. This generator line is preferably selected to be close to the common generator line 23 so as to camouflage the presence of the antenna once the device has been put into place on an object or a portion of an object. In this particular case, the metal filament 28 is disposed level with the inner flap 22 of the envelope-constituting sleeve, and the outer wall of the sleeve also has a local notch or cutout 29 at one end of the filament 28 to enable it to be grasped by an appropriate clamp for the purpose of tearing said wall (the antenna-filament then also acting as a tear strip), in a manner explained in greater detail below, when it is desired to disconnect the device 10 from the object with which it is associated. It should be observed that this type of metal filament constitutes an antenna operating by resonance and not by radiofrequency electromagnetic waves, and that it is incapable of being deactivated. For more information about this technology, reference can be made to above-mentioned document EP-A-0 698 561.

Independently of the presence of an antenna-forming metal filament, it would be possible in a variant to provide for the envelope to be fitted with a conventional type of tear strip (not shown herein) extending along a generator line of the main compartment 24.

The other main component of the device 10 is constituted by a portion of the other object, specifically in the variant shown in FIGS. 1 to 5, by an elongate identity and/or antitheft plate. There can thus be seen an elongate plate 30 organized in the form of a box. This plate 30 has a wall 31 in which there is formed a narrow longitudinal slot referenced 32. This longitudinal slot 32 has a closed end 33 close to one end of the plate (the rear end in FIG. 1) and another end 34 that opens out in the near end of said plate.

The slot 32 is specially dimensioned, both in width and in length.

Figure 3A:
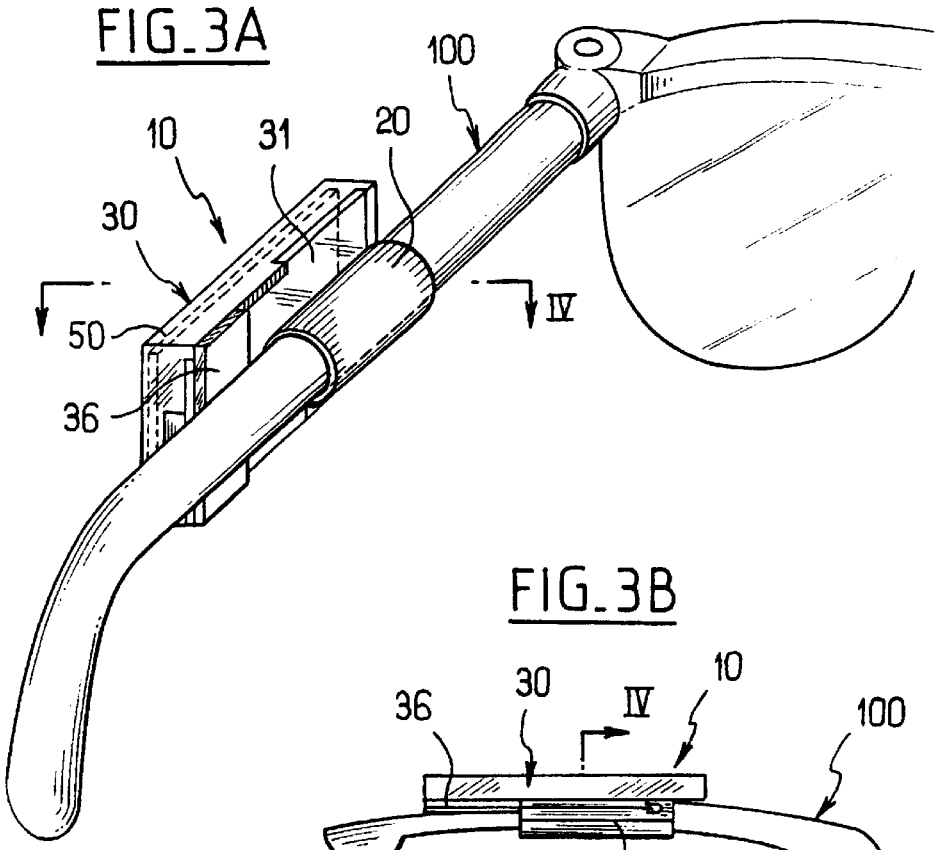
FIGS. 3A and 3B show how the above-mentioned device is placed on an object or a portion of an object, and specifically respectively on a temple of eyeglasses and on the clip of a pen, after the corresponding wall of the envelope has been shrunk around the object or portion of an object.

The width of the slot 32 is selected to allow two thicknesses of the envelope 20 to pass therethrough at the common generator line 23 thereof, while not allowing the elongate pin 26 to pass through, with the pin then being placed behind the wall 31 of the plate 30. Because of this organization, the elongate pin 26 co-operates with the wall 31 to hold the envelope 20 to the elongate plate 30 after the envelope has been heat-shrunk onto the first object together with the other object as constituted by the elongate plate 30. The device 10 is designed to be associated with an object or a portion of an object (the "first" object) while being intimately fixed on said object or said portion of an object by causing the wall of the envelope where it corresponds to the main compartment to shrink onto the object, as shown in FIG. 3A for a temple of eyeglasses, or in FIG. 3B for a clip of a pen, and in the associated section of FIG. 4 where the portion of the associated object is given reference 100.

It is also appropriate to organize the plate 30 in such a manner that once the elongate pin 26 has been inserted via the entrance 34 of the slot 32, it can be locked into place in said slot so as to avoid any risk of disconnection, since that would spoil the effectiveness of any antitheft protection means that may be associated with the elongate plate 30, in particular when the plate is made in the form of a box receiving antitheft protection means referenced 50, such as a magnetoacoustic detection antenna.

To this end, locking means are provided, constituted in this case by a catch referenced 36 and secured to the plate 30, which catch is organized to close the open end 34 of the slot 32.

The catch 36 may be a part that is independent from the plate 30 and that is suitable for snap-fastening in its locking position so as to lock the inserted envelope in place. In such a variant (not shown here), the locking catch 36 could be made in the form of a short strip having two male studs suitable for snapping into two associated holes formed for this purpose in the plate 30. Nevertheless, it is advantageous to provide a catch that is mechanically associated with the plate 30, thereby making the catch easier to handle, and thus avoiding any risk of it becoming lost. As can be seen more clearly in FIGS. 1 and 5, the locking catch 36 is connected in this case to the box 30 by a hinge-forming ligament 37 enabling the catch to pivot between a release position (shown in FIG. 5) in which the entrance 34 of the slot 32 is disengaged, and a locking position (shown in FIGS. 1 to 4) in which the entrance 34 of the slot 32 is closed.

Figure 5:
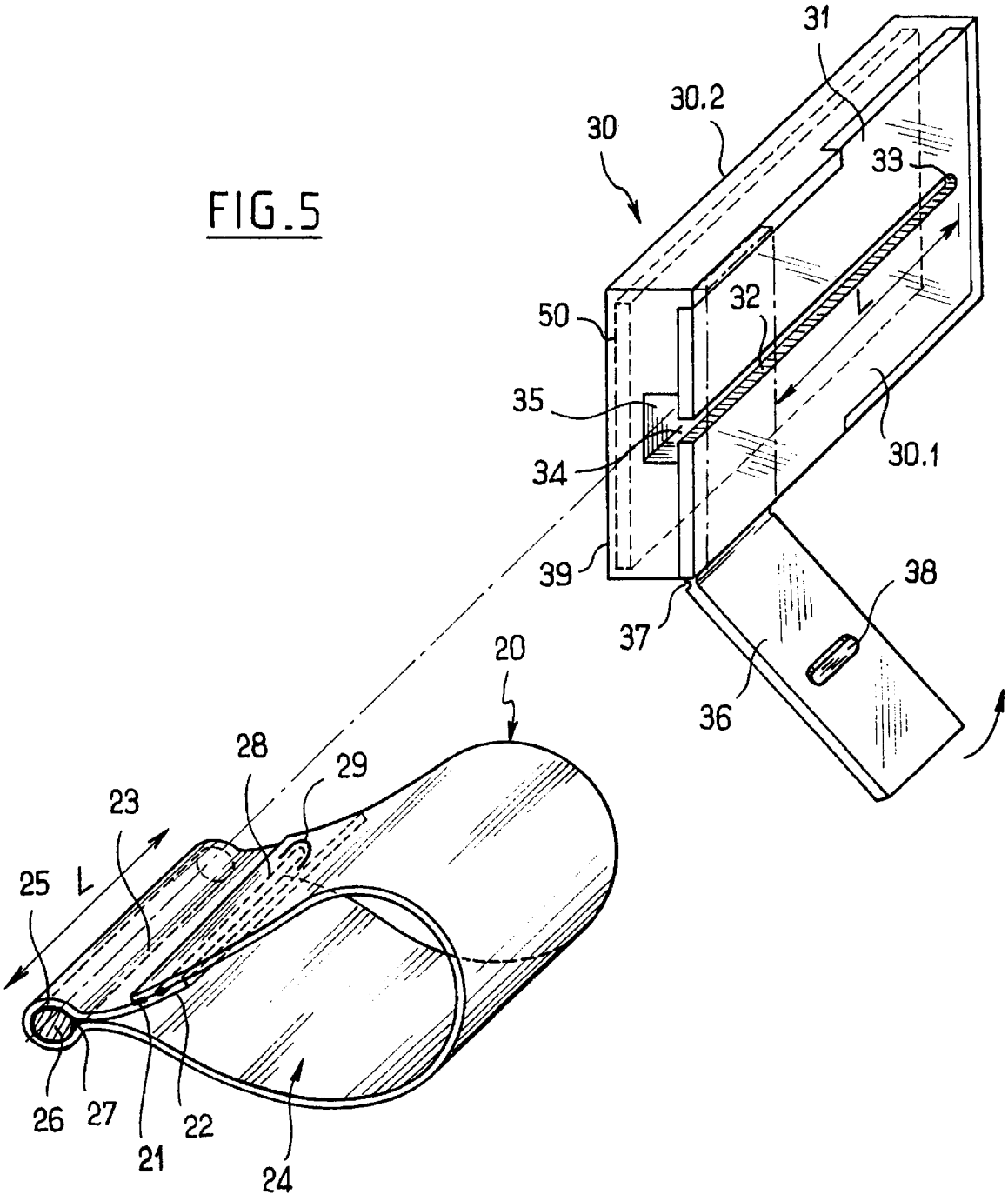
FIG. 5 is an exploded perspective view showing how the above-mentioned device is assembled, prior to an envelope fitted with its elongate pin being inserted into the slot in the plate, the locking catch thereof being in its release position so as to disengage the entrance to said slot, the locking position of said catch being shown in chain-dotted lines.

The box 30 carrying the magnetoacoustic detection antenna 50 can thus reused after it has been detached from the envelope 20 heat-shrunk on the object. Nevertheless, it is appropriate to ensure that the number of times the box is used remains small in practice, which can easily be achieved by designing the ligament 37 so as to allow a limited number of uses before it breaks naturally, e.g. a maximum number of handling operations in the range five to ten. In order to avoid any risk of the envelope 20 being disengaged in untimely manner from the insertion slot 32, it is advantageous to provide for the catch 36 to be lockable in its locking position. This can be achieved by any mechanical means such as snap-fastening. Specifically, as can be seen more clearly in FIG. 5, a stud 38 may be provided on the inside face of the pivoting catch 36, which stud is positioned and dimensioned in such a manner as to be suitable for snapping into the slot 32 when the catch 36 is folded down onto the wall 31 of the box 30. In FIG. 5, reference L designates the length of the envelope 20 and of its associated elongate pin 26, and this length L is to be found on the main portion of the slot 32 situated between the end 33 thereof and the edge of the overlap provided by the catch 36 when it is folded down. The envelope 20 is thus securely held between two end abutments in the associated portion of the slot 32.

As mentioned above, the elongate plate may be implemented in monolithic form having its longitudinal slot 32 only. Such a variant is shown in section in FIG. 6A, with the elongate plate being given reference 30'. In this case, the rear face 39 opposite from the face 31 serves essentially for supporting identity means referenced 39.1, 39.2, e.g. a label giving weight and price, or a medium carrying a bar code, or a digital label, or indeed a solar cell. Nevertheless, it is advantageous to organize the elongate plate 30 in the form of a box, as illustrated by the variant shown, particularly for the purpose of receiving sophisticated antitheft means 50 such as a magnetoacoustic detection antenna. Under such circumstances, it is appropriate to provide a notch 35 in each of the end facets of the housing 30, with the notches being of a profile suitable for passing the portion of the envelope which corresponds to the auxiliary compartment 25 in which the elongate pin 26 is disposed. Depending on circumstances, the notches 35 may be restricted to the end walls of the box 30, or they may constitute the open ends of a longitudinal housing formed inside said box.

Figure 3B:
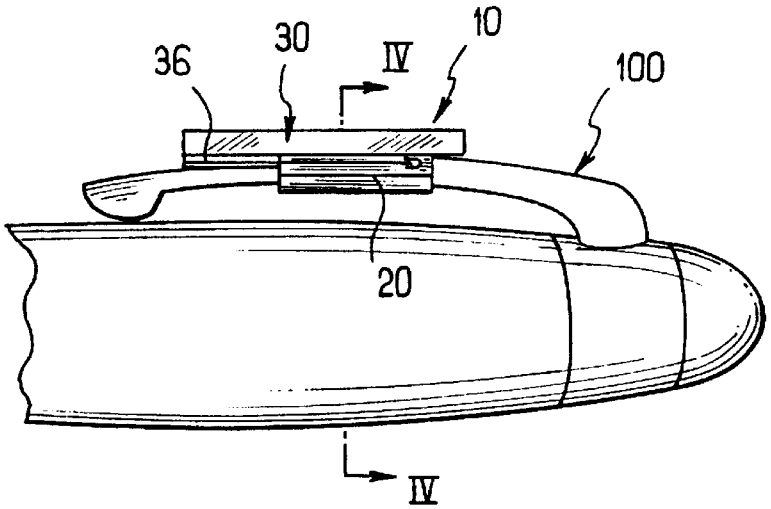
Figure 4:
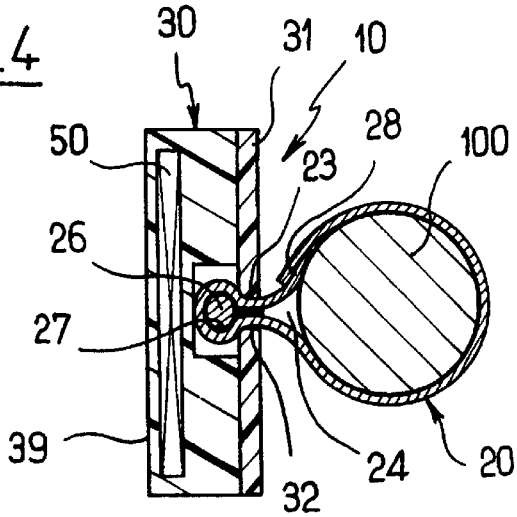
FIG. 4 is a section on IV—IV of FIGS. 3A or 3B, showing more clearly the mechanical link that is achieved in this way after the wall of the envelope outside the plate has been shrunk.

A device such as the device described above is put into place by performing a method which consists in threading the object or the portion of an object concerned 100 through the compartment 24 of the envelope 20 and then heat-shrinking the wall of the main compartment 24 so as to secure the device 10 to the object 100. This gives the situation shown in FIGS. 3A, 3B, and 4. The object 100 may be of a very wide variety of types, in particular selected from the fields of perfumery, cosmetics, and stationary. Nevertheless, it is advantageous, as shown in the applications of FIGS. 3A and 3B, to provide for the object or the portion of the object 100 that is threaded through the main compartment 24 of the envelope 20 to extend over the locking catch 36, thereby naturally locking said catch once heat-shrinking has been performed.

FIG. 5 also shows a box 30 made by assembling together two components given references 30.1 and 30.2, specifically a lid 30.1 having the catch 36 secured thereto and a box proper 30.2, with the edges where these two components meet being notched so that once they have been snap-fastened together positive locking is provided to prevent the lid 30.1 from sliding relative to the box 30.2 in the slot direction like a drawer.

The link between two objects as provided by the device 10 is both very reliable and quick to put into place. As shown in FIG. 5, it suffices to thread the portion of the envelope 20 fitted with its elongate pin 26 into the slot 32 until it comes into abutment against the end 33 of the slot 32. Thereafter the locking catch 36 can be raised and snapped into its locking position. This provides the device as shown in FIGS. 1 and 2. Linking to the other object can then easily be performed, e.g. on a temple of eyeglasses or on the clip of a pen, by subjecting the wall concerned to localized heating, e.g. by blowing hot air or by moving the wall close to the flame of a gas burner.

It will be understood that in this position, the device 10 does not prevent the object 100 being examined, nor does it prevent it from being tried on if the object is a frame for eyeglasses. In addition, the small size of the box 30 (in practice a box will be used in the form of a rectangular parallelepiped having dimensions of 5 mm×20 mm×45 mm) is entirely compatible with the use of display stands of the kind conventionally used by opticians.

Once a customer has decided to acquire an object fitted with such a link device, it is necessary to separate the device 10, with this being done by cutting through the associated envelope. Various means can be envisaged for this purpose, and for example it is possible to use a sharp blade (not shown) inserted between the object 100 and the box 30, so as to cut through the envelope substantially along its common generator line 23, or to provide a traditional type of tear strip (not shown here) extending along a generator line of the main compartment 24. Another, and particularly elegant way of solving the problem, consists in providing means for tearing the wall constituted by the metal filament 28 that is provided as an electromagnetic antenna. Under such circumstances, the wire of the antenna itself constitutes a tear strip, thus performing two functions. In order to avoid it being too easy to take hold of the end of the filament, which would considerably degrade the performance of the device in terms of protection provided, it can be appropriate to provide a small notch or cutout such as the cutout 29 shown herein so that only a small end portion of the filament is accessible, and then only by means of a special tool such as fine-nosed pliers.

Once the two components have been separated in this way, it is easy to remove the residual envelope wall from the object, and the residual envelope wall from the box. Thereafter, it suffices to insert another envelope in the box, and to lock said envelope in position by closing the pivoting clamp.

In practice, depending on the size of the object concerned, it is preferable for the heat-shrink envelope to be constituted by a film having a high shrink percentage (e.g. 70% to 80%) with thickness of the order of 50 $\mu$m to 60 $\mu$m. It will easily be understood that with relatively thick films, it becomes more difficult to tear the heat-shrunk envelope, thus making the above-mentioned solution of using the antenna filament as the tear strip even more effective.

Other applications of the link device of the invention can naturally be envisaged. By way of non-limiting example, two other variants are shown in FIGS. 6B and 6C.

Figure 6A:
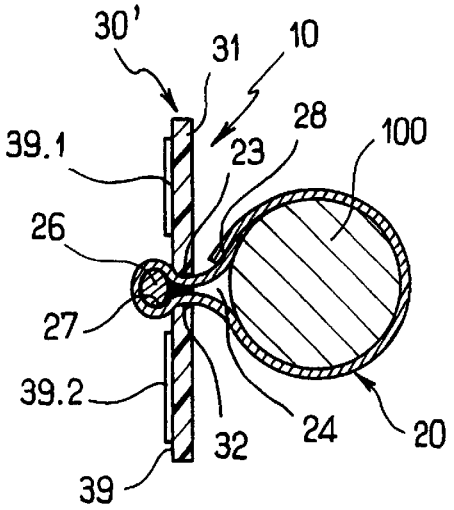
FIGS. 6A, 6B, and 6C show other variants of the link device of the invention.

In these variants, the object having a wall with a narrow longitudinal slot is no longer an elongate plate constituting a box (FIGS. 1 to 5) or otherwise (FIG. 6A).

Figure 6B:
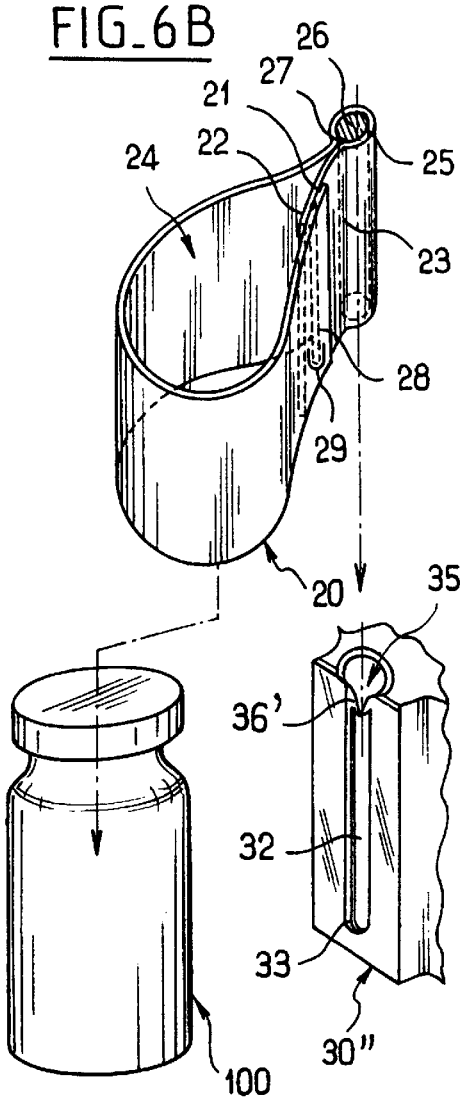

In FIG. 6B, an object 100 can be seen which is provided to be received in the main compartment 24 of the envelope 20. The other object, referenced 30", is a projection having a housing 35 with a slot 32 designed to receive the portion of the envelope 20 that surrounds the pin 26. In this case, the associated locking means is not implemented in the form of a catch that can be snap-fastened on the other object or that is typically mounted thereon and connected thereto, but in the form of two entrance barbs referenced 3', organized to allow passage in the insertion direction only (like a fishing hook). The projection 30" may form part of a support for holding objects (objects such as the object 100), or it may be another object such as a receptacle or packaging of a receptacle (in which case the object 100 is a promotion associated with the object being sold).

Figure 6C:
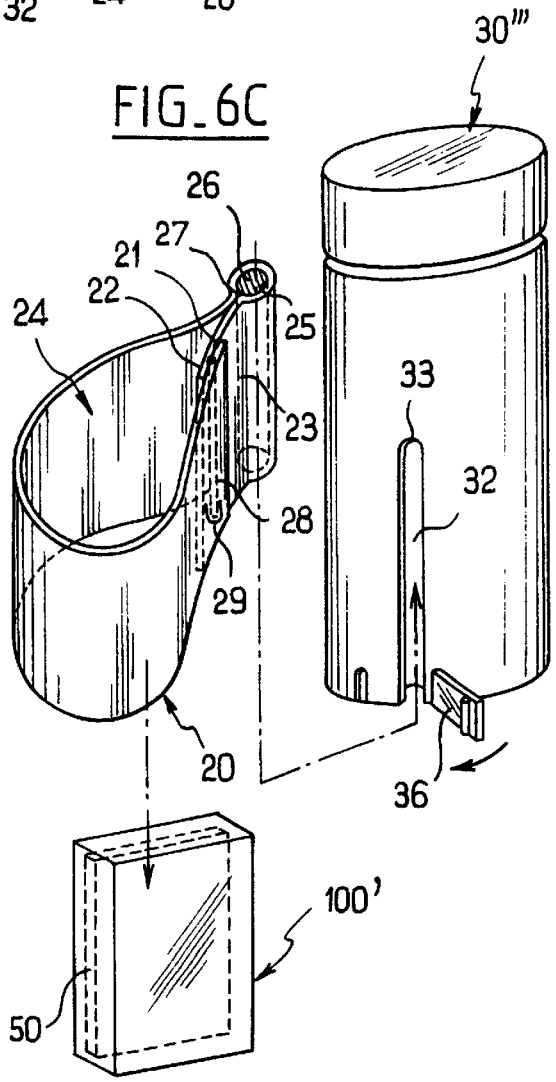

In FIG. 6C, the object referenced 100' which is received in the main compartment 24 of the envelope 20 is an identity plate and/or an antitheft plate, e.g. a box-plate of the same type as the plate 30 as described above, and fitted with a magnetoacoustic antenna 50. The other object, referenced 30'" is constituted in this case by a flask that has a local recess with a slot 32 and a locking clamp 36, so as to receive the portion of the envelope 20 that surrounds the pin 26. In a variant, the object 30'" may be packaging or a support for an object, providing it is fitted with a highly effective theft-proofing system.

It may be observed that the envelope 20 shown in FIGS. 6B and 6C is, as before, fitted with antitheft means in the form of a filament 28 constituting an electromagnetic antenna.

In the variant of FIG. 6B, this antitheft means is the only antitheft means, while in the variant of FIG. 6C, it is additional to the protection provided by the magnetoacoustic antenna.

It is thus possible to make an identity and/or antitheft system which is both simple in structure and extremely effective in terms of countering "shrinkage".

The invention is not limited to the embodiment described above, but on the contrary covers any variant that uses equivalent means to reproduce the essential characteristics specified above.

What is claimed is:

1. A device for making an antitheft link between two objects, the device comprising an envelope (20) of heat-shrink plastics material, implemented in the form of a sleeve whose walls are brought together locally along a common generator line (23) to form a main compartment (24) and an auxiliary compartment (25), the main compartment being open at both ends and being designed to envelop a first one (100, 100') of the two objects to be connected together, and the auxiliary compartment (25) having an elongate pin (26) disposed therein, which pin extends parallel to said common generator line;

a wall (31) provided on the other object (30, 30', 30",30'"), which wall has formed therein a narrow longitudinal slot (32) opening out at one of its ends, said slot being dimensioned firstly to enable the common generator line (23) of the above-mentioned envelope (20) to be inserted therein so that the associated elongate pin (26) is disposed behind the wall (31) and co-operates therewith to provide the link between said other object and the envelope when heat-shrunk onto said first object, and secondly to lock the envelope (20) as inserted in the slot (32) by associated locking means (36, 36') organized to close the open end (34) of said slot; and antitheft means (28, 50) integrated in the envelope (20), and/or at least one of the two objects.

2. A device according to claim 1, wherein the elongate pin (26) is held in the associated auxiliary compartment (25) of the envelope (20) by adhesive.

3. A device according to claim 1 wherein the elongate pin (26) is a single piece extending over the full length of the associated auxiliary compartment (25) of the envelope (20).

4. A device according to claim 1, wherein the elongate pin (26) is made in the form of a bar or a tube of plastics material.

5. A device according to claim 1, wherein the envelope (20) is fitted with antitheft means in the form of a metal filament (28) constituting an electromagnetic antenna, said filament extending along a generator line of the main compartment (24).

6. A device according to claim 5, wherein the metal filament (28) is disposed level with an inside flap (22) of the sleeve constituting the envelope (20), and the outer wall of said sleeve has a local cutout or notch (29) level with one end of the filament (28) to enable it to be grasped for the purpose of tearing said wall.

7. A device according to claim 1, wherein the envelope (20) is fitted with a tear strip extending along a generator line of the main compartment (24).

8. A device according to claim 1, wherein one of the objects is an elongate identity and/or antitheft plate (30, 30', 100').

9. A device according to claim 8, wherein the elongate plate (30, 100') is implemented in the form of a box serving to house antitheft means such as an antenna for magnetoacoustic detection (50).

10. A device according to claim 8, wherein one of the walls of the elongate plate (30, 30') is the wall (31) having the narrow longitudinal slot (32).

11. A device according to claim 1, wherein the locking means associated with the narrow longitudinal slot (32) is constituted by a locking catch (36) which is either snap-fastenable to the wall (31) or else is connected to the wall (31) by a hinge-forming ligament (37) such that said catch can pivot between a release position in which the entrance (34) of the slot (32) is disengaged, and a locking position in which the entrance (34) of the slot (32) is closed.

12. A device according to claim 11, wherein the ligament (37) is designed to allow use on a limited number of occasions, thereafter breaking naturally.

13. A device according to claim 11, wherein the catch (36) is lockable in its locking position e.g. by a stud (38) secured to said catch and snap-fastening in the slot (32).

14. A device according to claim 1, wherein the locking means associated with the narrow longitudinal slot (32) is constituted by a pair of inlet barbs (36') organized to allow passage in the insertion direction only.

15. A heat-shrink envelope specially designed for constituting a link device according to claim 1, the envelope being made in the form of a sleeve of heat-shrink plastics material whose walls are brought together locally along a common generator line (23) to form both a main compartment (24) open at both ends, and an auxiliary compartment (25) in which an elongate pin (26) extending parallel to said common generator line is held in place.

16. An envelope according to claim 15, fitted with antitheft means in the form of a metal filament (28) constituting an electromagnetic antenna, said filament extending along a generator line of the main compartment (24).

* * * * *

UNITED STATES PATENT AND TRADEMARK OFFICE

CERTIFICATE OF CORRECTION

PATENT NO. : 6,317,046 B1
DATED : November 13, 2001
INVENTOR(S) : Eric Fresnel

It is certified that error appears in the above-identified patent and that said Letters Patent is hereby corrected as shown below:

Title page,
Item [73], the first Assignee's name is -- SENSORMATIC FRANCE -- instead of "SENSORIMATIC FRANCE."

Signed and Sealed this

Twenty-first Day of May, 2002

*Attest:*

*Attesting Officer*

JAMES E. ROGAN
*Director of the United States Patent and Trademark Office*